US008047193B2

(12) United States Patent
Nonaka et al.

(10) Patent No.: US 8,047,193 B2
(45) Date of Patent: Nov. 1, 2011

(54) NON-CORE DRILL BIT

(75) Inventors: Takuma Nonaka, Tokyo (JP); Naohide Murakami, Tokyo (JP); Kazuhisa Morita, Oshu (JP)

(73) Assignee: Max Co., Ltd., Tokyo (JP)

( * ) Notice: Subject to any disclaimer, the term of this patent is extended or adjusted under 35 U.S.C. 154(b) by 356 days.

(21) Appl. No.: 12/376,517

(22) PCT Filed: Aug. 9, 2007

(86) PCT No.: PCT/JP2007/065652

§ 371 (c)(1), (2), (4) Date: Feb. 5, 2009

(87) PCT Pub. No.: WO2008/018559

PCT Pub. Date: Feb. 14, 2008

(65) Prior Publication Data

US 2010/0260562 A1 Oct. 14, 2010

(30) Foreign Application Priority Data

Aug. 10, 2006 (JP) ..... 2006-217767

(51) Int. Cl.
*B24D 7/10* (2006.01)

(52) U.S. Cl. ..... 125/20; 451/548

(58) Field of Classification Search ..... 451/548, 451/527, 530, 449, 450, 461; 125/20
See application file for complete search history.

(56) References Cited

FOREIGN PATENT DOCUMENTS

| | | |
|---|---|---|
| JP | 64-4605 | 1/1989 |
| JP | 05-30891 | 8/1993 |
| JP | 5-245827 | 9/1993 |
| JP | 2001-232628 | 8/2001 |

*Primary Examiner* — Robert Rose
(74) *Attorney, Agent, or Firm* — Drinker Biddle & Reath LLP

(57) ABSTRACT

A non-core drill bit is provided with a metallic seat 2 attached to the tip of a shank of a boring tool, a cylindrical first diamond grindstone body 3 fixed to the metallic seat 2 and having a recessed cutout portion 10 to be opened to one side, and a second diamond grindstone body 4 installed inside the recessed cutout portion 10. The tip of the second diamond grindstone body 4 is positioned on the metallic seat 2 side from the tip of the first diamond grindstone body 3. The inner side of the tip face of the first diamond grindstone body 3 is preferably formed in an approximately reverse-conical recessed shape.

6 Claims, 7 Drawing Sheets

NON-CORE DRILL BIT

TECHNICAL FIELD

The present invention relates to a non-core drill bit for boring concrete, cement mortar, building blocks and others.

BACKGROUND ART

For example, where an outdoor unit of an air conditioner is mounted to a concrete wall, the concrete wall is first bored, anchor bolts are mounted into the thus bored holes, and the outdoor unit is fixed to the anchor bolts with screws.

As a boring tool for making the above-described bored holes, there is known a hammer drill and a diamond drill. The hammer drill is a tool for hammering and boring the concrete wall, while a carbide tip of a bit is pierced to break the wall. However, this tool causes troublesome hammering noise.

On the other hand, the diamond drill is a tool in which a diamond grindstone body is fixed to the tip of a base constituting a seat, making a hole by firmly pressing a rotating bit against the concrete wall and cutting the surface thereof. Therefore, this tool is advantageous in lower working noise.

Incidentally, the diamond drill must continue to constantly press a bit attached to the tip thereof, thereby generating high heat resulting from frictional heat. Thus, there is generally used a wet-type diamond drill which allows water to flow inside the bit (refer to Patent Documents 1 and 2). However, since this type requires a hole made for allowing water to pass through a center thereof, the bit must be hollow. Therefore, in the case of a core drill bit, it requires, a device for circulating cooling water and also requires means for removing concrete debris (swarf) remaining inside the hollow bit.

In contrast, a dry-type diamond drill, which is free of water, is constituted so that it is at least partially solid, the tip thereof is formed in a flat shape and a diamond grindstone body is fixed on an iron-based seat. The dry-type diamond drill does not require a device for circulating water or means for removing concrete debris. This drill is provided with a slit-like recessed cutout portion opened to one side, and swarf is to be removed outside from the recessed cutout portion.

Patent Document 1: JP-Y-05-030891

Patent Document 2: JP-A-05-245827

However, a conventional non-core drill bit (hereinafter, simply referred to as a bit) has the following disadvantages.

(1) In FIG. 9(*a*), since a bit 20 has a solid base 23 (the numeral 22 denotes a recessed cutout portion of a diamond grindstone body 21), cutting is done by the outer periphery side and the center side of the diamond grindstone body 21. In this case, there is a difference in rotating speed between the outer periphery side 21*a* and the center side 21*b*. When the bit 20 is rotated to perform boring, the outer periphery side 21*a* is higher in speed, thereby responding to concrete more efficiently. However, as the center side 21*b* is slower in speed, it responds to concrete less efficiently. Since the boring speed is dependent on working capability of the center side which is lower in working capability, the boring speed is slow while the bit 20 is new. After repetition of boring work, the bit 20 wears at the center, by which hole-cutting can be performed on the outer periphery side to improve the performance. It takes, however, some time by the time a predetermined performance is obtained.

(2) The performance will be improved as a bit wears at the center. However, due to a difference in rotating speed between the outer periphery side and the inner periphery side of the bit, a conically projected portion uncut and remaining develops at the center of the leading end of a hole 15. At the beginning, no problem is found. However, when the outer periphery side wears to decrease in height, and develops into a state shown in FIG. 9(*b*), a top portion 17 of a projected portion 16 which remains in a conical shape on the tip center side of the diamond grindstone body 21 is in contact with a base 23. The base 23 is free of abrasive material such as diamond, rotating quite remarkably slowly at the center, thereby the projected portion 16 is cut inefficiently. Further, the above case is also found where, in place of the projected portion, stones and the like are clogged at the center. Boring is not performed smoothly unless the center portion is cut and, therefore, the bit 20 is once taken out to remove the projected portion 16 and the boring must be started again, which is troublesome. Thus, the boring speed is sharply decreased due to the above reason.

(3) When the boring work is further continued from a state in (2), not only does the boring speed decrease but the diamond grindstone body 21 also lowers in height at the outer periphery portion. At the same time, the outer periphery face of a base 23 (made of iron and free of diamond grains) is more vulnerable to wear than the bit tip, thereby as shown in FIG. 9(*c*), this part also develops into a tapered shape. The outer periphery face 24 of a bit 20 also acts as a guide portion for providing straight-forward boring. Therefore, if the guide portion 24 is made short after repetition of boring work, there may be found a poor straight-forward boring. When the straight-forward guide is not provided, the bit 20 tends to move in a direction where resistance is small, as indicated by the arrow in FIG. 9(*b*). Ingredients of concrete are not uniform and the resistance is therefore irregular, by which a hole may be easily deflected. Since, for example, the previously described anchor bolt is formed exactly in a straight shape, it becomes difficult to insert it into the deflected hole. There is also found a decreased capacity in retaining the anchor bolt inside the hole.

DISCLOSURE OF THE INVENTION

One or more embodiments provide a non-core drill bit capable of keeping the boring performance substantially constant from a beginning of use to an end thereof.

According to a first aspect of the present invention, a non-core drill bit is provided with: a metallic seat attached to the tip of a shank of a boring tool; an approximately annular or cylindrical first diamond grindstone body fixed to the metallic seat and having a recessed cutout portion to be opened to one side; and a second diamond grindstone body installed inside the recessed cutout portion, in which the second diamond grindstone body is formed so as to be lower than the first diamond grindstone body.

According to a second aspect of the present invention, in the non-core drill bit of the first aspect, the inner side of the tip face of the first diamond grindstone body is formed in an approximately reverse-conical recessed shape.

According to a third aspect of the present invention, in the non-core drill bit of the first or the second aspect, the height of the second diamond grindstone body is made substantially equal to a minimum height by which the outer periphery face of the first diamond grindstone body is able to provide a straight-forward boring guide.

According to a fourth aspect of the present invention, in the non-core drill bit of the first or the second aspect, the height of the outer periphery face of the first diamond grindstone body remaining when the top portion of a projected portion uncut and remaining in a conical shape at the center of a hole by boring work is in contact with the base is set to be a minimum height capable of providing a straight-forward boring guide.

According to a fifth aspect of the present invention, in the non-core drill bit of any one of the first to the fourth aspect, the first diamond grindstone body is installed as a separate member from the second diamond grindstone body and then formed in an integral manner.

According to the above-described first aspect, the non-core drill bit is provided with a metallic seat attached to the tip of a shank of a boring tool, an approximately annular or cylindrical first diamond grindstone body fixed to the metallic seat and having a recessed cutout portion to be opened to one side, and a second diamond grindstone body installed inside the recessed cutout portion, in which the second diamond grindstone body is formed so as to be lower than the first diamond grindstone body. Therefore, after repetition of boring work, the first diamond grindstone body wears off and the top portion of a conically projected portion uncut and remaining at the center of the tip of a hole will soon be in contact with the second diamond grindstone body. The second diamond grindstone body is installed inside a recessed cutout portion, and it is thereby cut off in a short time due to the fact that the rotating speed is slow and the top portion of the projected portion is accordingly small. As described above, since the second diamond grindstone body can be used to cut the projected portion in an accelerated manner, the boring speed is not decreased. Further, since the projected portion is cut by the second diamond grindstone body, swarf cut by the second diamond grindstone body is similar in appearance to swarf cut by the first diamond grindstone body. Thus, swarf from both can be discharged together without any special procedures. As a result, it is possible to retain substantially the constant boring performance from the beginning of use to the end thereof.

According to the above-described second aspect, the inner side of the tip face of the first diamond grindstone body is formed in an approximately reverse-conical shape. Therefore, the outer periphery edge of the tip face is able to cut well into a material to be bored such as concrete, and the outer periphery side of a bit is also higher in rotating speed, by which the working capability is greater than the inner side which is slower in rotating speed. Therefore, when a non-core drill bit is first pressed against concrete, cutting is started from the outer periphery edge, and the inner periphery side portion lower in working capability is not in contact with the face of the concrete. Thus, it is possible to perform boring at high speed from the beginning of use.

According to the above-described third aspect, the height of the second diamond grindstone body is substantially equal to a minimum height by which the outer periphery face of the first diamond grindstone body is able to provide a straight-forward boring guide. Therefore, it is possible to know the end of use by observing the extent of wear of the second diamond grindstone body in the boring work and also to provide a good straight-forward boring guide even at the end of use.

According to the above-described fourth aspect, the height of the outer periphery face of the first diamond grindstone body remaining when the top portion of a projected portion uncut and remaining in a conical shape at the center of a hole after the second diamond grindstone body wears by boring work is in contact with the base is set to be a minimum height capable of providing a straight-forward boring guide. Therefore, when the projected portion is in contact with a base, the boring speed decreases greatly due to the base which has no boring performance. Further, the exposed face of the base can be clearly visibly recognized. Thus, it is possible to know reliably the timing of the end of using a non-core drill bit. Still further, the outer periphery face of the first diamond grindstone body secures the straight-forward guide even at the time when the bit is completely used and a bored hole will not be deflected until the bit is completely used, thus making it possible to retain appropriately members such as an anchor bolt. It is also possible to keep the second diamond grindstone body to a minimum amount.

According to the above-described fifth aspect, the first diamond grindstone body is installed as a separate member from the second diamond grindstone body. Accordingly, a problem that a projected portion uncut and remaining is changed in shape, depending on whether or not a material to be bored is concrete, cement mortar, or light-weight building blocks which contain stones, and the bit is also accordingly changed in usability is resolved by changing a composition of the second diamond grindstone body based on the material to be bored so as to make it possible to provide an optimal non-core drill bit.

If both the first diamond grindstone body and the second diamond grindstone body are changed in compositions according to a material to be bored, it becomes possible to provide a non-core drill bit optimal for boring.

Other aspects and advantages of the invention will be apparent from the following description, the drawings and the claims.

BRIEF DESCRIPTION OF THE DRAWINGS

FIG. 2(*b*) is a front elevational view of the non-core drill bit.

FIG. 2(*c*) is a bottom plan view of the non-core drill bit.

FIG. 8(*b*) is a cross sectional view showing an aspect of attaching the second diamond grindstone body.

FIG. 8(*c*) is a cross sectional view showing an aspect of attaching the second diamond grindstone body.

FIG. 9(*b*) is an explanatory diagram of a wear state resulting from the use of the conventional non-core drill bit.

FIG. 9(*c*) is an explanatory diagram of a wear state resulting from the use of the conventional non-core drill bit.

DESCRIPTION OF REFERENCE NUMERALS

Figure 1:
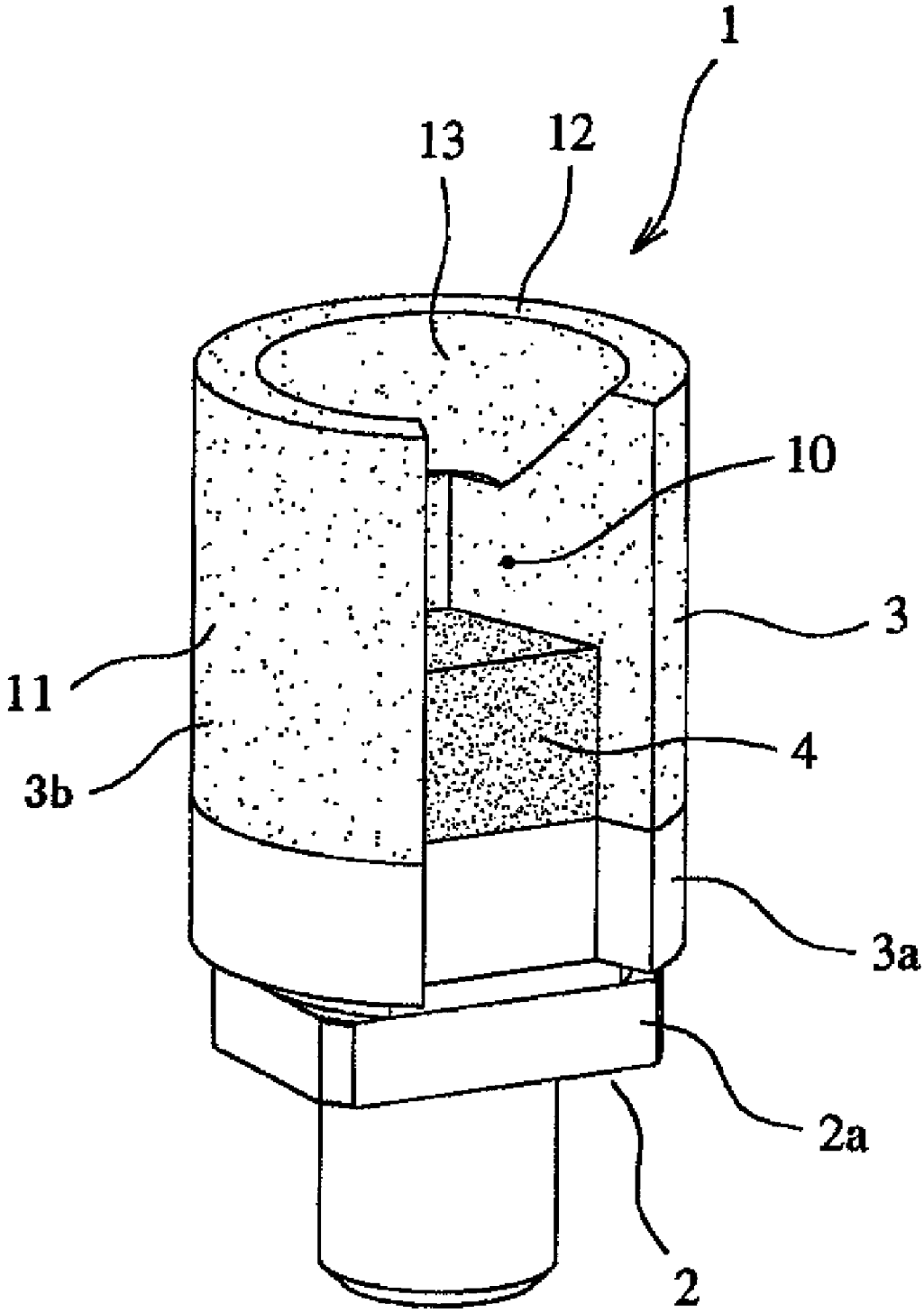
FIG. 1 is a perspective view of a non-core drill bit of the present invention.

1: non-core drill bit
2: metallic seat
3: first diamond grindstone body
3*a*: diamond free portion
3*b*: diamond containing portion
4: second diamond grindstone body
10: recessed cutout portion
11: outer periphery face

BEST MODE FOR CARRYING OUT THE INVENTION

Figure 2A:
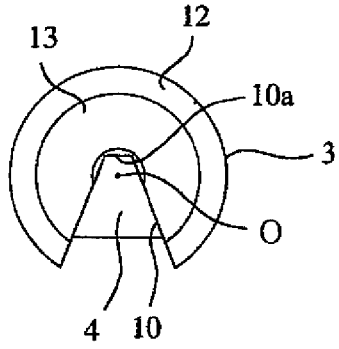
FIG. 2(*a*) is a plan view of the non-core drill bit.
Figure 2B:
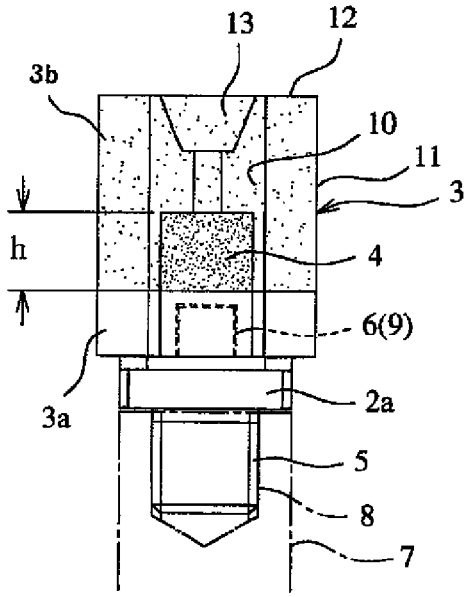
Figure 2C:
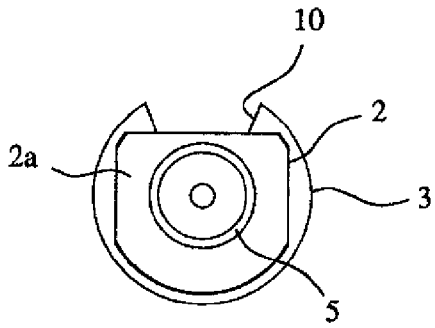

FIG. 1 is a perspective view of the bit of the present invention, and FIG. 2(*a*) is a plan view of the bit. FIG. 2(*b*) is a front elevational view of the bit in FIG. 2(*a*) and FIG. 2(*c*) is a bottom view of the bit.

In the above drawings, the numeral 1 denotes a bit. The bit 1 is constituted with a metallic seat 2, a first diamond grindstone body 3 provided on the metallic seat 2, and a second diamond grindstone body 4 provided on the inner side of the first diamond grindstone body 3.

The metallic seat 2 is made of iron and includes an external thread portion 5 on one side of an approximately rectangular-shaped seating portion 2*a* having a segmental portion on one side thereof and a raised portion 6 on the other side. As shown in FIG. 2(*b*), the external thread portion 5 is formed so as to be screwed into an internal thread portion 8 at the tip of a shank 7 of a boring tool. Further, the raised portion 6 is formed so as to be fitted into a recessed portion 9 formed at the bottom of the first diamond grindstone body 3.

The first diamond grindstone body 3 is formed in a cylindrical shape having a recessed cutout portion 10 opened on the outer periphery face, that is, a sintered body prepared by mixing metal bonded grains (for example, alloy based on copper and tin) with diamond grains and sintering them. A base portion layer 3*a* of the first diamond grindstone body 3 is a diamond free portion which contains no diamond grains and a diamond containing portion 3*b* is installed on the tip side of the diamond free portion. Then, the recessed portion 9 is formed at the center of the diamond free portion 3*a* and fixed by brazing, with the raised portion 6 of the metallic seat 2 fitted into the recessed portion 9. The diamond free portion 3*a* has no boring capability, and a base 100 is constituted with the diamond free portion 3*a* and the metallic seat 2.

The diamond free portion 3*a* of the first diamond grindstone body 3 is that which forms at the center thereof a recessed portion 9 for being fitted into the raised portion 6 of the metallic seat 2, enlarging a contact area between the metallic seat 2 and the diamond grindstone body, thereby the first diamond grindstone body 3 is less likely to be peeled from the metallic seat 2. Therefore, this is not necessarily needed. The first diamond grindstone body, which does not contain the diamond free portion, may be directly fixed to the metallic seat. Further, the outer periphery face 11 of the first diamond grindstone body 3 acts as a guide for providing a straight-forward boring, and since the diamond free portion 3*a* and the metallic seat do not contain diamond grains, the outer periphery face 11 thereof will gradually wear off, resulting in a failure of providing a straight-forward boring guide.

Figure 9A:
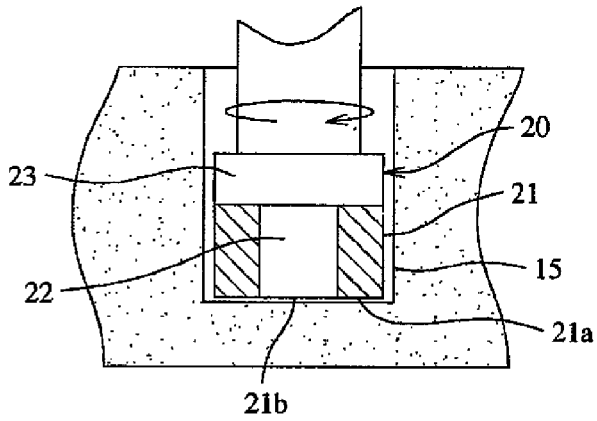
FIG. 9(*a*) is an explanatory diagram of a wear state resulting from the use of a conventional non-core drill bit.
Figure 9B:
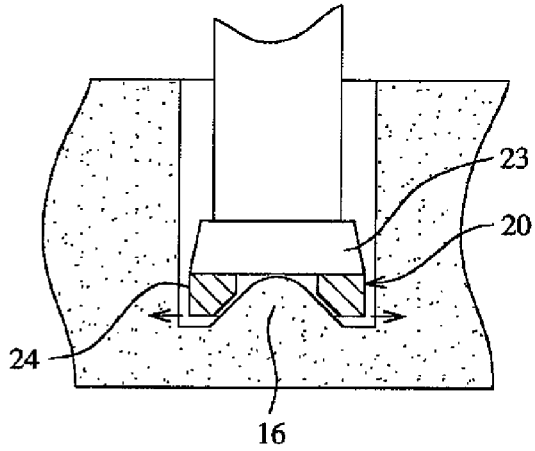
Figure 9C:
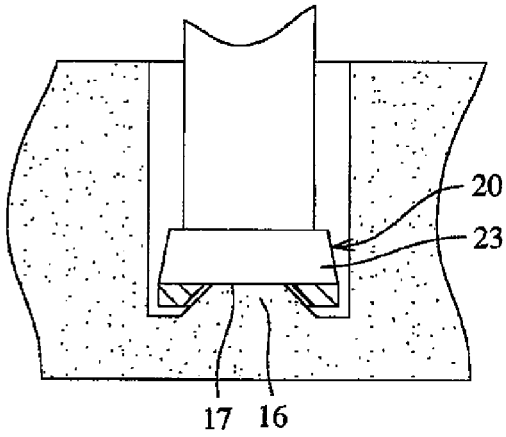

The above-described recessed cutout portion 10 is formed in a fan-like shape in planar view, and the base portion 10*a* thereof is formed so as to surpass the center O of the bit 1. Further, the inner periphery face 13 on the inner side of a ring-shaped outer periphery edge 12 on the tip face of the first diamond grindstone body 3 is formed in an approximately reverse-conical recessed shape. The angle of inclination of the approximately reverse-conical inner periphery face 13 is formed so as to be substantially equal to that of an inclined face of a projected portion (the numeral 16 indicated in FIG. 9(*b*)) uncut and remaining in a conical shape when a bit 20 is conventionally used.

Since the recessed cutout portion 10 of the first diamond grindstone body 3 is a portion for removing outside concrete swarf which is peeled off mainly on boring, this portion is not necessarily formed in a fan-like shape in planar view.

Next, the second diamond grindstone body 4 is also a sintered body having the same constitution as that of the first diamond grindstone body 3, provided with the same outer side shape as the inner side shape of the recessed cutout portion 10 of the first diamond grindstone body 3, and fixed by brazing to the tip face of the diamond free portion 3*a* which is formed to be smaller than the recessed cutout portion 10 and exposed to the recessed cutout portion 10 of the first diamond grindstone body 3. Therefore, the second diamond grindstone body 4 is arranged so as to be set back to the inner side from the outer end portion of the recessed cutout portion 10 of the first diamond grindstone body 3.

Further, the second diamond grindstone body 4 is formed so as to be lower than the first diamond grindstone body 3. That is, the tip of the second diamond grindstone body 4 in the axial direction is positioned on the metallic seat 2 side from the tip of the first diamond grindstone body 3. The height of the second diamond grindstone body 4 is set so as to be substantially equal to a minimum height "h" so that the outer periphery face 11 (excluding the diamond free portion 3*a*) of the first diamond grindstone body 3 can provide a straight-forward boring guide. More specifically, the length of the second diamond grindstone body 4 in the axial direction is shorter than that of the diamond containing portion 3*b* in the axial direction. In addition, the axial direction of the bit 1 means a direction of the rotation axis of the bit 1. If the diameter of the first diamond grindstone body 3 is approximately 16 mm, the straight-forward boring guide can be provided at a minimum height of approximately 6 mm (an axial length).

Next, a description will be given for a use aspect of the above-constituted bit 1. In this case, the diamond free portion 3*a* and the metallic seat 2 are collectively denoted as a base 100. In addition, in the following description, the base 100 corresponds to the metallic seat 2 in an embodiment where the first diamond grindstone body 3 does not have the diamond free portion 3*a*.

Figure 3:
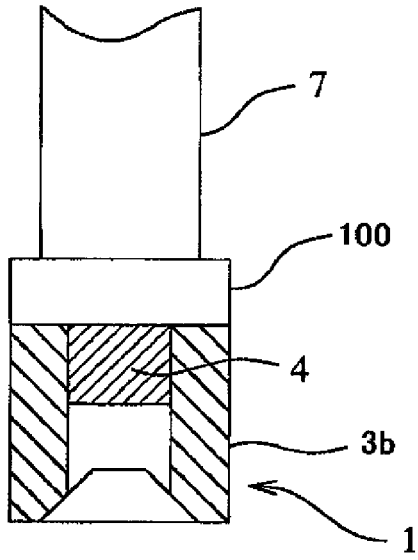
FIG. 3 is a front elevational view showing the beginning of use of the non-core drill bit.
Figure 4:
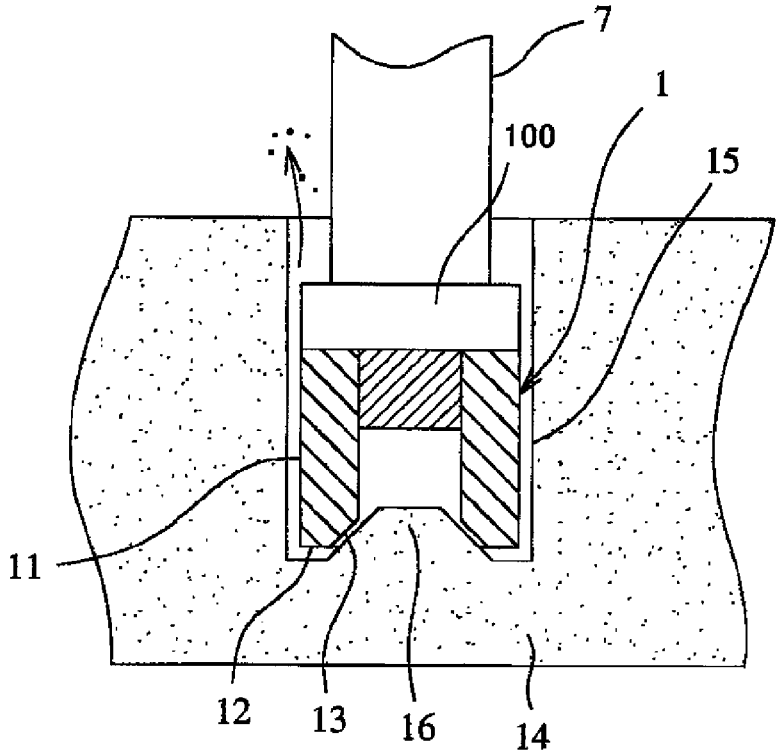
FIG. 4 is a front elevational view showing the non-core drill bit which is in use.

As shown in FIG. 3, the above-constituted bit 1 is attached on the tip of a shank 7 of a boring tool and rotated. Then, as shown in FIG. 4, when the tip of the first diamond grindstone body 3 is pressed against concrete 14, the concrete 14 is cut from a part in contact with the bit 1 and bored. The numeral 15 denotes the hole.

Figure 5:
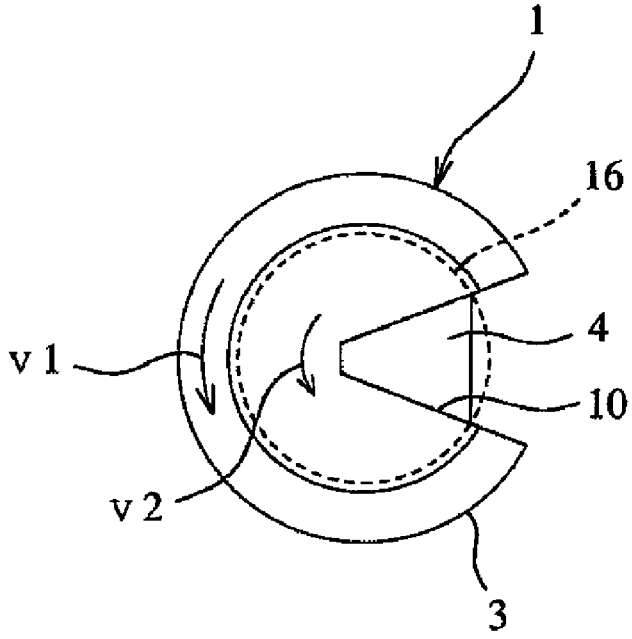
FIG. 5 is an explanatory diagram of a cutting aspect of a projected portion when illustrated from a flat surface.

Incidentally, in the above-described bit 1, the inner periphery face 13 of the outer periphery edge 12 is formed in a reverse conical shape. Therefore, the outer periphery edge 12 of the bit 1 is first in contact with concrete 14. As shown in FIG. 5, the rotating speed v1 on the outer periphery side of the bit 1 is high, while the rotating speed v2 on the inner periphery side is slow. Thus, the outer periphery side is greater in working capability than the inner side. As a result, when the bit 1 starts to be pressed against the concrete 14, the outer periphery edge 12, which cuts better, starts to cut, and an inner side portion lower in working capability is not in contact with the face of the concrete 14. Therefore, it is possible to perform boring at high speed from the beginning of use.

Then, the inner periphery face 13 of the bit 1 is also in contact with the concrete 14, thereby cutting is proceeded by all the tip of the bit 1. A projected portion 16 which is uncut and remains in a conical shape is generated at the center of the bit 1, and grows. However, due to the fact that concrete 14 contains stone debris or the like, this portion, when it grows, is broken or crushed by vibration resulting from the rotation and discharged is naturally from the recessed cutout portion 10. Therefore, it is acceptable that the working capability is low at the center and the boring speed is influenced only slightly. The thus cut swarf is discharged via the side portion of the base 100 from the recessed cutout portion 10 to the shank 7 side. The recessed cutout portion 10 is formed so as to include the center of the bit 1. Thus, as shown in FIG. 5, when this portion makes one rotation, it covers all the periphery face of the bit 1, thereby the thus cut swarf is all discharged from the recessed cutout portion 10.

Figure 6:
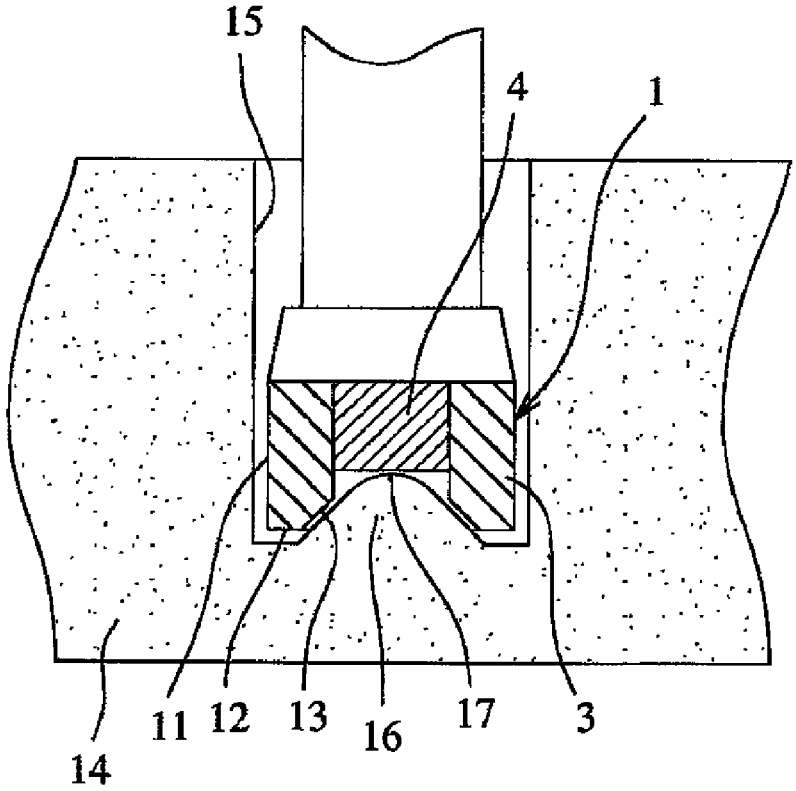
FIG. 6 is a front elevational view showing the non-core drill bit which is close to the end of use.

After repetition of boring work, the diamond grindstone body 3 wears off, and as shown in FIG. 6, a top portion 17 of the projected portion 16 of concrete 14 is then in contact with the second diamond grindstone body 4. The second diamond grindstone body 4 is formed so as to include the center of the first diamond grindstone body 3. Thus, although slow in rotating speed, it is able to cut off in a short time the top portion 17 of the projected portion 16 which is small. As described above, the second diamond grindstone body 4 can be used to cut the projected portion 16 in an accelerated manner. Thus, an outer side portion of the concrete 14 in contact with the bit 1 is cut by the first diamond grindstone body 3, while an inner side portion thereof is cut by the second diamond grindstone body 4 in an auxiliary manner.

Figure 7:
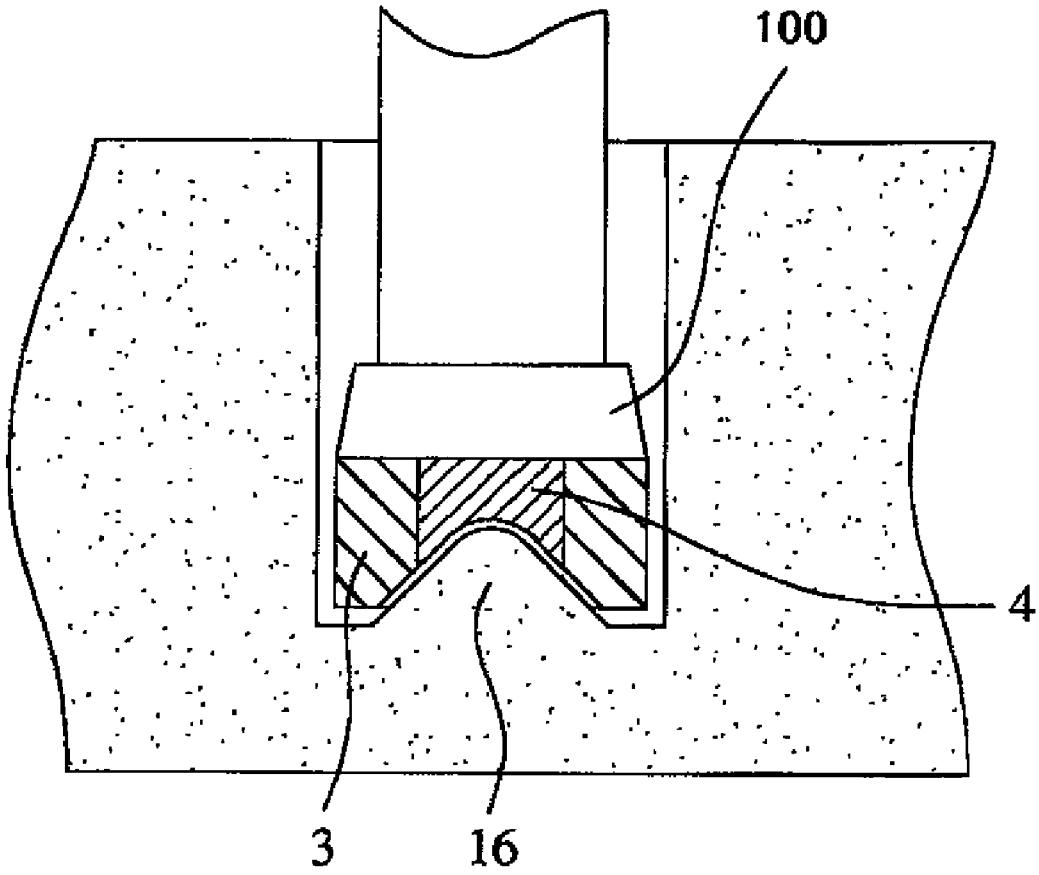
FIG. 7 is a front elevational view showing the non-core drill bit which is at the end of use.

When the boring further proceeds, the first diamond grindstone body 3 wears off and, as shown in FIG. 7, the surface of the second diamond grindstone body 4 has no flat portion and is formed into a reverse conical shape. Then, the height of the outer periphery face of the first diamond grindstone body 3 (excluding the diamond free portion 3*a*) is gradually brought close to the height of each outer periphery face 11 of the second diamond grindstone body 4 (that is, the tip position of the diamond containing portion 3*b* in the axial direction is brought close to the tip position of each outer periphery face 11 of the second diamond grindstone body 4 in the axial direction). As shown in FIG. 2(*b*), the height of the second diamond grindstone body 4 "h" (length "h" of the second diamond grindstone body 4 in the axial direction) is set so as to be substantially equal to a minimum length by which the outer periphery face 11 of the first diamond grindstone body 3 can provide a straight-forward boring guide. Therefore, further continuous use will result in a situation that the first diamond grindstone body 3 in itself is not able to provide the straight-forward boring guide. Further, even on completion of use, the outer periphery face 11 of the first diamond grindstone body 3 acts to securely provide the straight-forward boring guide, and the thus bored hole will not be deflected until completion of use. It is, therefore, possible to retain appropriately members such as an anchor bolt.

As described above, since the base 100 (including the diamond free portion 3*a*) does not contain diamond grains, the outer periphery face thereof will gradually wear, resulting in a failure of providing the straight-forward boring guide.

According to the above-constituted bit 1, the following effect can be obtained. That is, an approximately reverse-conical shaped inner periphery face 13 is formed on the inner side of the tip face of the first diamond grindstone body 3. Further, as shown in FIG. 6, the inner periphery face 13 is formed so as to be substantially equal in angle of inclination to the conical projected portion 16 made when a conventional bit 1 is used. Thus, an ideal shape is given to the tip of the bit 1 from the beginning. Therefore, the bit is able to exhibit a predetermined performance and perform boring at high speed from the beginning of use.

Further, in association with the boring work, the conical projected portion 16 is made at the center of the tip of the thus bored hole 15. When the top portion 17 thereof is in contact with the second diamond grindstone body 4, an outer side portion of concrete 14 in contact with the bit 1 is cut by the first diamond grindstone body 3, while an inner side portion thereof is cut by the second diamond grindstone body 4 in an auxiliary manner. Thus, there is no decrease in boring speed.

Still further, when the surface of the second diamond grindstone body 4 wears off and is formed into a reverse conical shape, the height thereof is substantially equal to a minimum height by which the outer periphery face 11 of the first diamond grindstone body 3 is able to provide a straight-forward boring guide. No further boring is secured for the straight-forward guide. Therefore, it is possible to know the use limit of the bit 1 and timing of exchanging the bit 1 by observing the extent of wear of the second diamond grindstone body 4. Further, the thus bored hole 15 will not be deflected until the bit is completely used, making it possible to retain appropriately members such as an anchor bolt.

Figure 8A:
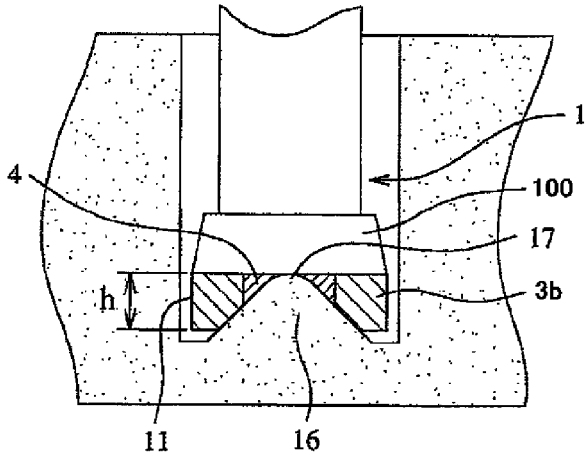
FIG. 8(*a*) is a cross sectional view showing an aspect of attaching a second diamond grindstone body.
Figure 8B:
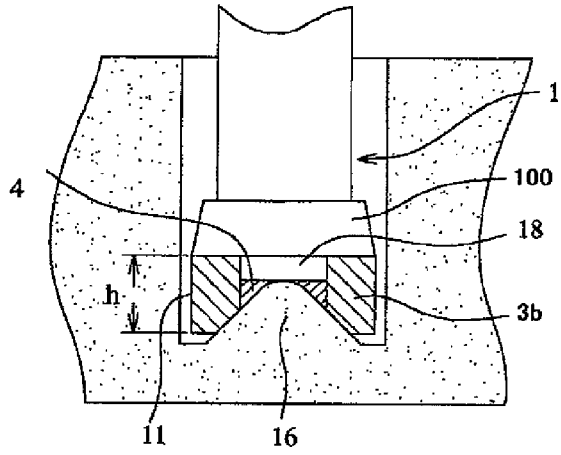
Figure 8C:
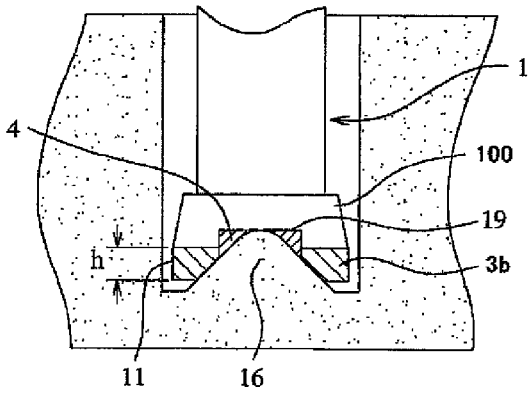

Further, when the top portion 17 of the projected portion 16 made at the center of the hole 15 on boring is in contact with the base 100, the height of the outer periphery face 11 of the first diamond grindstone body 3 (excluding the diamond free portion 3*a*) may be adjusted so as to give a minimum height, h, capable of providing a straight-forward boring guide (it may be adjusted so that the outer periphery face 11 of the diamond containing portion 3 in the axial direction is set to be a minimum axial length "h" capable of providing the straight-forward boring guide). For example, as shown in FIG. 8(*a*), it is most preferable that the height of the outer periphery face 11 of the first diamond grindstone body 3 (excluding the diamond free portion 3*a*) when the top portion 17 of the projected portion 16 is in contact with the base 100 is adjusted so as to be a minimum height "h" capable of providing the guide (it is most preferable that an axial length of the outer periphery face 11 of the diamond containing portion 3*b* is adjusted so as to be a minimum axial length "h" which can provide the guide). In this case, when the height of the outer periphery face 11 of the first diamond grindstone body 3 (excluding the diamond free portion 3*a*) is lower than the above height "h" (when an axial length of the outer periphery face 11 of the diamond containing portion 3*b* is shorter than the above axial length "h") as shown in FIG. 8(*b*), a stepped portion 18 corresponding to the shortage may be added to the base 100 and the second diamond grindstone body 4 is fixed thereto. Further, in this case, when the height of the outer periphery face 11 of the first diamond grindstone body 3 (excluding the diamond free portion 3*a*) is higher than the above height "h" (when an axial length of the outer periphery face 11 of the diamond containing portion 3*b* is longer than the above axial length, h), as shown in FIG. 8(*c*), a recessed portion 19 may be formed at the base 100 and the second diamond grindstone body 4 is fixed thereto.

According to the above constitution, the height of the outer periphery face 11 of the first diamond grindstone body (excluding the diamond free portion 3*a*) (an axial length of the outer periphery face 11 of the diamond containing portion 3*b*) remaining when the top portion 17 of the projected portion 16 uncut and remaining in a conical shape at the center of a hole after the second diamond grindstone body 4 wears by the boring work is in contact with the base 100 is set to be a minimum height "h" (an axial length "h") capable of providing straight-forward boring guide. Therefore, the straight-forward boring guide can be secured on complete use of the bit. Further, when the projected portion 16 is in contact with the base 100, the boring speed decreases greatly due to the base 100 which has no boring performance. Still further, an exposed face of the base 100 can be clearly visibly recognized. Therefore, it is possible to reliably know the use limit of the bit 1 and the timing of complete use. It is also possible to keep the second diamond grindstone body 4 to a minimum quantity.

Further, the first diamond grindstone body 3 and the second diamond grindstone body 4 may be formed integrally, or they may be installed as separate members and constituted in an integral manner. Where they are installed as separate members, a projected portion uncut and remaining is changed in shape, depending on whether or not a material to be bored is concrete 14, cement mortar, or light-weight building blocks which contain stones, and the bit 1 is also changed in usability. The second diamond grindstone body 4 is changed in compositions according to the material to be bored, thereby making it possible to provide an optimal non-core drill bit.

The present invention has been described in detail and by referring to specific embodiments. It is apparent for a person skilled in the art that the present invention may be changed or modified in various ways within a scope not departing from the spirit and scope of the invention.

The present application is based on the Japanese patent application (No. 2006-217767) filed on Aug. 10, 2006, with the content incorporated herein as reference.

INDUSTRIAL APPLICABILITY

The present invention is applicable to a non-core drill bit for boring concrete, cement mortar, building blocks and others.

The invention claimed is:

1. A non-core drill bit comprising:

a metallic seat attached to a tip of a shank of a boring tool;

a first diamond grindstone body, having an approximately annular or cylindrical shape, fixed to the metallic seat, and having a recessed cutout portion opened to an outer periphery face; and a second diamond grindstone body installed inside the recessed cutout portion;

wherein a tip of the second diamond grindstone body in an axial direction is positioned on a side of the metallic seal from a lip of the first diamond grindstone body in the axial direction, wherein an inner side of a tip face of the first diamond grindstone body is formed in a reverse-conical recessed shape, and transforms into a planar outer peripheral edge, the planar outer peripheral edge adapted to engage a material to be bored before the inner side of the tip face.

2. The non-core drill bit according to claim 1, wherein the first diamond grindstone body includes: a diamond free portion which is free of diamond grains and positioned on the side of the metallic seat in the axial direction; and a diamond containing portion which contains diamond grains and is positioned on a side of the tip in the axial direction, and a length of the second diamond grindstone body in the axial direction is shorter than a length of the diamond containing portion in the axial direction.

3. The non-core drill bit according to claim 1, wherein a length of the second diamond grindstone body in the axial direction is substantially equal to a minimum axial length of the first diamond grindstone body by which an outer periphery face of the first diamond grindstone body is able to provide a straight-forward boring guide.

4. The non-core drill bit according to claim 2, wherein a length of an outer periphery face of the diamond containing portion in the axial direction which remains when a top portion of a projected portion of the material to be bored which is uncut and remains in a conical shape at a center of a hole of the non-core drill bit by boring work is in contact with the diamond free portion is set to be a minimum length capable of providing a straight-forward boring guide.

5. The non-core drill bit according to claim 1, wherein the first diamond grindstone body and the second diamond grindstone body are installed as separate members and then formed in an integral manner.

6. The non-core drill bit according to claim 1, wherein the second diamond grindstone body intersects with a rotational axis of the non-core drill bit.

* * * * *